United States Patent [19]

Easterwood

[11] Patent Number: 4,911,446

[45] Date of Patent: Mar. 27, 1990

[54] BALL HANDLING GAME

[75] Inventor: Thea J. Easterwood, South Fulton, Tenn.

[73] Assignee: Atlas Smith, Inc., Tucker, Ga.

[21] Appl. No.: 158,892

[22] Filed: Feb. 22, 1988

[51] Int. Cl.[4] ..... A63B 67/14

[52] U.S. Cl. ..... 273/109

[58] Field of Search ..... 273/109, 110

[56] References Cited

U.S. PATENT DOCUMENTS

| | | | |
|---|---|---|---|
| 1,972,587 | 9/1934 | Fairchild | 273/109 |
| 2,237,748 | 4/1941 | Schwarzenzer | 273/109 |
| 3,218,074 | 11/1965 | Miller | 273/109 |
| 3,304,090 | 2/1967 | Morris | 273/109 |
| 3,666,268 | 5/1972 | Candusso | 273/109 |
| 4,561,656 | 12/1985 | David | 273/110 |
| 4,669,727 | 6/1987 | David | 273/110 |
| 4,746,121 | 5/1988 | David | 273/110 |
| 4,822,045 | 4/1989 | Shoemaker, Jr. | 273/110 |

*Primary Examiner*—Edward M. Coven
*Assistant Examiner*—Gary Jackson
*Attorney, Agent, or Firm*—B. J. Powell

[57] ABSTRACT

A ball handling game with a fork member and a ball adapted to roll along the fork member where the fork member has reversing end sections to facilitate movement of the ball around the ends of the fork legs.

4 Claims, 3 Drawing Sheets

BALL HANDLING GAME

BACKGROUND OF THE INVENTION

Games which require manipulation of a pair of diverging support rails to roll a ball therealong and then turning the rails over at the instant the ball drops therebetween so that the ball rolls back down the opposite edges of the support rails are known in the art. Examples of such prior art games are disclosed in the following U.S. patents:

| U.S. Pat. No. | Inventor | Issue Date |
|---|---|---|
| 1,972,587 | W. Fairchild | September, 1934 |
| 2,237,748 | A. Schwarzenzer | April, 1941 |
| 3,218,074 | K. J. Miller | November, 1965 |
| 3,304,090 | L. Morris | February, 1967 |
| 3,666,268 | A. F. Condusso | May, 1972 |

One of the problems associated with these prior art games is that the ball drops quickly between the spaced apart ends of the diverging support rails thereby requiring rapid rotation of the guide rails to keep the ball from falling out from between the rails. This has made it difficult for anyone but the most dexterous to use the game.

SUMMARY OF THE INVENTION

These and other problems and disadvantages associated with the prior art are overcome by the invention disclosed herein by providing a fork member with legs which serve to change the rate of rotation of the ball at the point where the ball passes between the legs while at the same time increasing the gripping force between the guide rails and the ball. The additional rotation imparted to the ball helps drive the ball around the pass-through point between the legs while at the same time causing the ball to take longer to move through the pass-through point to decrease the speed at which the legs need to be rotated. This reduces the difficulty of learning to play the game using the fork and the ball.

The end sections on the fork legs diverge at an angle greater than that of the main sections of the legs. Those portions of the diverging end sections adjacent the support edges of the support rails diverge at a greater angle than the central longitudinally extending sections so that the rotation of the ball increases as the ball drops into these greater diverging portions yet is retained by the central portions of these sections. As the faster rotating ball moves along the central portion of the diverging sections, it pushes the ends of the diverging fork legs apart, however, the resiliency of the legs is sufficient to cause the legs to grip the ball and allow the ball to rotate as it passes between the legs. This gives more time to the person manipulating the legs to turn them over before the ball falls free of the legs.

These and other features and advantages of the invention will become more apparent upon consideration of the following detailed description and accompanying drawings wherein like characters of reference designate corresponding parts throughout the several views and in which:

Figure 1:
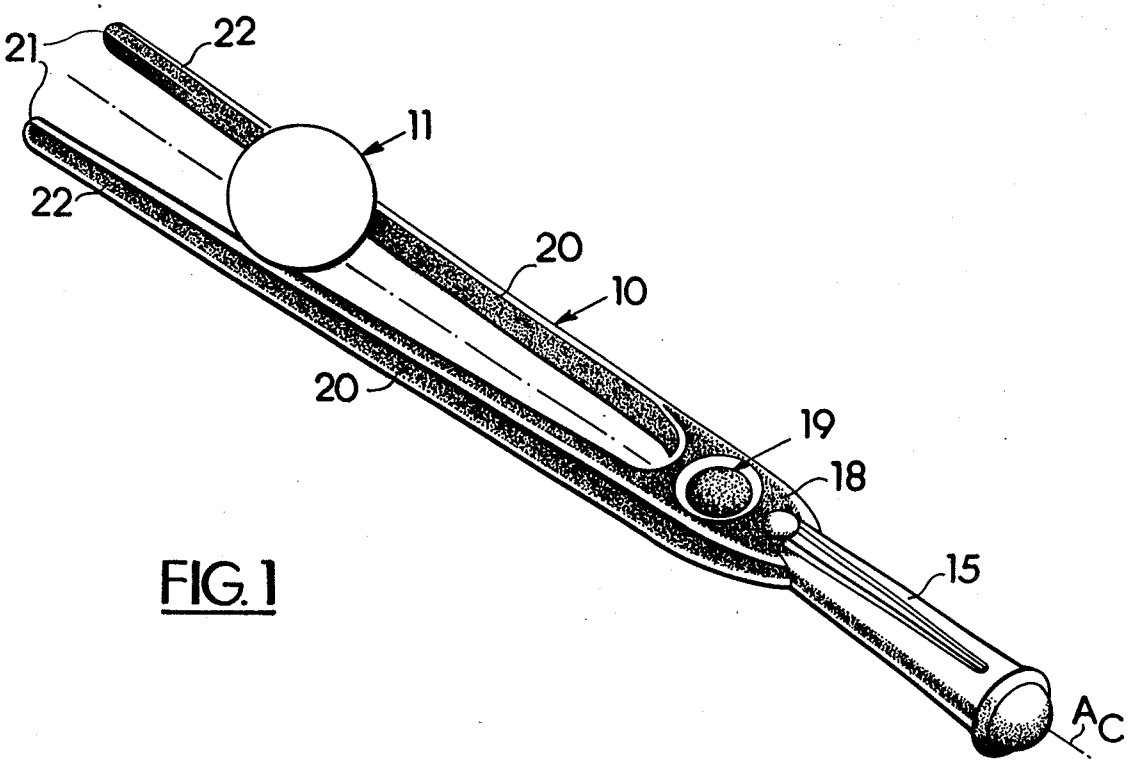
FIG. 1 is a perspective view illustrating the invention.

These features and the following detailed description disclose specific embodiments of the invention, however, it is to be understood that the inventive concept is not limited thereto since it may be embodied in other forms.

DETAILED DESCRIPTION OF ILLUSTRATIVE EMBODIMENTS

Referring to the drawings, it will be seen that the invention is embodied in a hand-held fork member 10 and a ball 11 adapted to roll along fork member 10 as the user manipulates the fork member 10. The fork member 10 includes a manually grippable handle 15 with a pair of fork legs 16 projecting out from one end of the handle 15 so that the handle 15 and fork legs 16 are arranged along a common axis $A_C$. A transition section 18 connects the handle 15 with the fork leg 16 and is provided on the opposite sides thereof with a stabilizing depression 19 for use by the user as will become more apparent and also serves as a ball holder to hold the ball when the invention is not in use.

Each of the legs 16 has a primary section 20 with a substantially constant cross-sectional size and shape that extends from the transition section 18 out to a prescribed distance $d_1$ from the projecting tip 21 of the leg 16. Each fork leg 16 also has a reversing end section 22 integral with the projecting end of the primary section 20 which extends outwardly to form the projecting tip 21 thereon.

Figure 3:
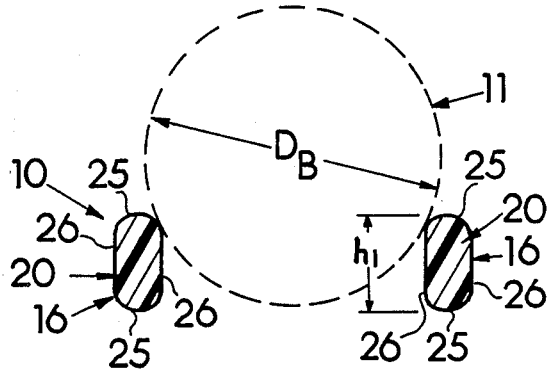
FIG. 3 is a cross-sectional view taken gradually along line 3—3 in FIG. 2.

As best seen in FIG. 3, the primary section 20 has rounded upper and lower ball support edge surfaces 25 and opposed side surfaces 26 generally parallel to each other. The height $h_1$ of the section 20 decreases toward the projecting end of the leg 16. While the ball is rolling down the primary sections 20 of the leg 16, the ball rolls along the uppermost edge surface 25 as will become more apparent. It will likewise be understood that the legs 16 diverge toward their projecting ends at an appropriate angle $A_1$ illustrated at about 6 degrees. The angle $A_1$ is selected so that the distance between the projecting tips 21 on the legs 16 is greater than the diameter $D_B$ of the ball 11 so that the ball will pass between the legs 16 before the ball reaches the projecting tips 21 yet will be supported on the legs 16 toward the opposite ends of the legs.

Figure 2:
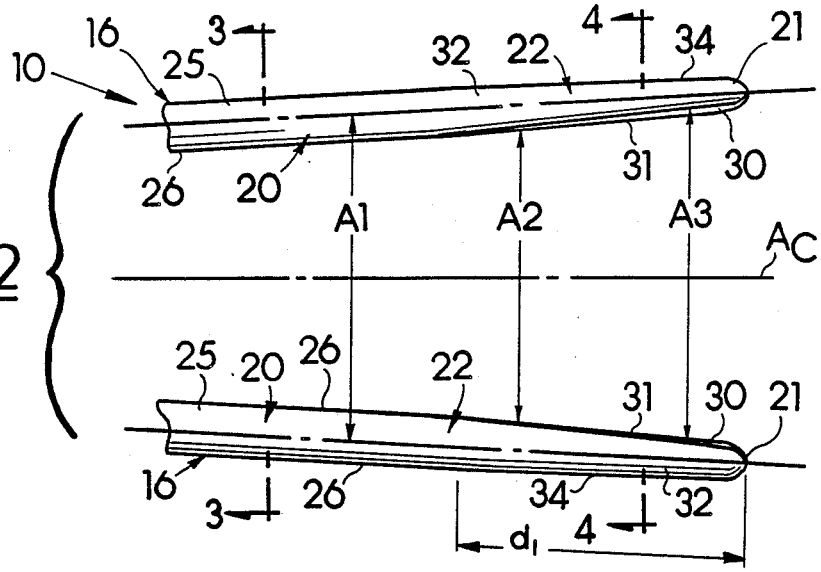
FIG. 2 is a partial top plan view showing the projecting ends of the legs on the fork.
Figure 4:
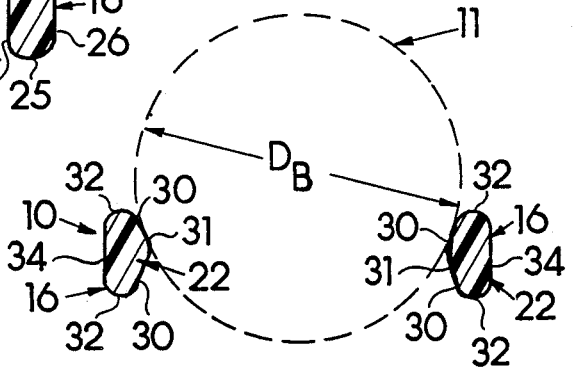
FIG. 4 is a cross-sectional view taken generally along line 4—4 in FIG. 2.

Referring now to FIG. 4, it will be seen that the cross-sectional shape of the reversing end sections 22 is different from that of the primary sections 20. The sections 22 define inwardly angled upper and lower ball support side surfaces 30 thereon which join along an inner ridge 31 centrally extending along the sections 22 on the inside thereof. The sections 22 also have upper and lower rounded edge surfaces 32 and a conveniently shaped outside surface 34. As best seen in FIG. 2, it will be seen that the ridges 31 on the sections 22 diverge at a greater angle $A_2$ than that of the legs 16 and is illustrated at about 10 degrees. The inside surfaces 30, however, diverge outwardly at an even greater angle $A_3$, which is illustrated at about 12 degrees.

While the ball 11 rolls along the edge surfaces 25 as it passes along the primary sections 20, the ball starts to roll along the inwardly angled inside surfaces 30 when it moves onto the end sections 22. This causes the ball 11 to rotate faster while at the same time still being supported between the sections 22. Finally, the ball moves far enough along the sections 22 for the ball to pass between the inside ridges 31. However, because the legs 16 are resilient, the ball 11 slightly forces the end sections 22 apart so that the ball continues to be gripped between the ridges 31. At this time, the fork member 10 is rotated 180° about its central axis $A_c$ and the ball 11 then rolls back up the inside surfaces 30 on the end sections 22 and finally back along the edge surfaces 25 on the primary sections 20.

Figure 5A:
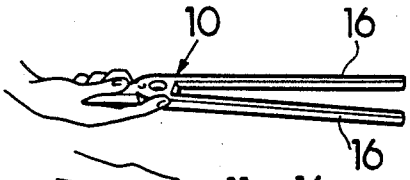
FIGS. 5A–5D are perspective diagrams illustrating the invention in use.
Figure 5B:
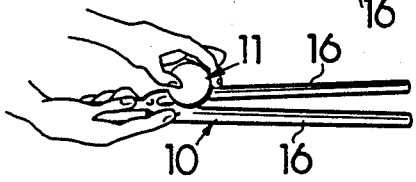
Figure 5C:
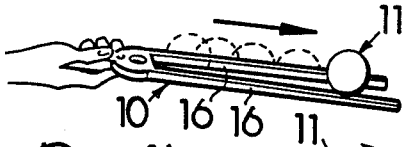
Figure 5D:
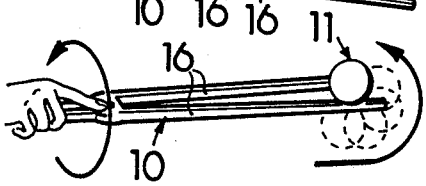

As seen in FIG. 5, the user holds the fork member 10 in his hand so that the legs 16 are about horizontal as seen in FIG. 5A. The user then places the ball 11 on the fork legs 16 adjacent the transition section 18 as seen in FIG. 5B. With the ball thusly located, the user tips the fork member 10 so that the projecting tips 21 move down sufficiently for the ball 11 to start rolling along the fork legs 16. When the ball 11 rolls onto the end sections 22 as illustrated in FIG. 5C, the user closely watches the action of the ball and rotates the fork member 10 180° about its axis $A_C$ when the user detects that the ball is passing the ridges 31 of the end sections 22. At the same time the user elevates the projecting ends of the fork legs 16 so that the ball will roll back down to the opposite side of the legs 16.

The ball 11 may be any type of ball. However, best results have been obtained with a resilient ball that defines rubber-like surface thereon so that it is easily gripped. One such ball is that currently in use for handball.

What is claimed as invention is:

1. A ball handling game comprising:

a fork member including a manually engageable handle and a pair of resilient fork legs, each having a prescribed leg axis and projecting from said handle and diverging from each other at a first prescribed angle between said leg axes substantially throughout the length thereof to form and open unconnected and opposite said handle; and a ball having a prescribed diameter adapted to roll along said fork legs and pass between said fork legs before said ball reaches the open unconnected end thereof, each of said fork legs including a reversing end section thereon defining a central ridge therealong having a width transversely of the plane of said leg axes less than the width of said fork leg, said central ridges on said end sections diverging from each other so that the distance between said ridges fartherest from said open end of said fork member is less than the ball diameter and diverges to a diameter greater than the ball diameter before the open end of said fork member is reached so that said ball passes between said central ridges from one side of said fork member the other while the resiliency of said fork legs causes said central ridges to grip said ball.

2. A ball handling game comprising:

a fork member having a common central axis and including a manually engageable handle and a pair of fork legs, each having a leg axis, projecting from said handle and diverging from each other at a first prescribed angle between said leg axis substantially throughout the length thereof to form an open unconnected end on said fork member opposite said handle, each of said fork legs defining a projecting and thereon and including a primary section adjacent the handle and projecting outwardly therefrom and a reversing end section integral with the projecting end of said primary section and adjacent the open unconnected end; and a ball adapted to roll along said fork legs from one end to the other, the diameter of said ball being such that said ball will roll along said fork legs and pass between said reversing end sections before said ball reaches the open end of said fork legs, said reversing end sections each defining an inwardly angled side surface on the inside thereof having an outer edge joining with the outermost surface of said leg relative to the plane of said leg axes and extending inwardly therefrom, said end sections each further defining a central ridge on the inside thereof centered on the plane defined by said leg axes and joining with the innermost edge of said side surface the innermost edges of said side surfaces on said end sections diverging from each other at a second prescribed angle greater than said first prescribed angle so that the distance between said central ridges on said end sections increases from less than the ball diameter at the inboard end thereof at said primary sections toward the projecting end thereof to a diameter exceeding the ball diameter so that the ball will pass therebetween before the ball reaches the projecting ends of said legs, the outermost edges of said side surfaces on said end sections diverging from each other at a third prescribed angle greater than said second prescribed angle so that the ball rolls down said side surfaces toward said central ridges with increasing rotational velocity to stabilize the ball as the ball passes between said central ridges.

3. The ball handling game of claim 2 wherein said fork legs are resilient so that said ball will be gripped as said ball passes between said end sections.

4. The game of claim 2 wherein each of said end sections further defines a second side surface on the inside thereof on the opposite side of said central ridge, said second side surface being a mirror image of said first side surface so that said fork member is reversible.

* * * * *